US010870561B2

(12) United States Patent
Bitz et al.

(10) Patent No.: US 10,870,561 B2
(45) **Date of Patent: *Dec. 22, 2020**

(54) MOBILE CRANE WITH BALLAST RECEIVING APPARATUS

(71) Applicant: Liebherr-Werk Ehingen GmbH, Ehingen (DE)

(72) Inventors: Markus Bitz, Laupheim (DE); Lars Eberhardt, Staig (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/226,829

(22) Filed: Dec. 20, 2018

(65) Prior Publication Data

US 2019/0194000 A1 Jun. 27, 2019

Related U.S. Application Data

(63) Continuation of application No. 14/927,804, filed on Oct. 30, 2015, now Pat. No. 10,189,683.

(30) Foreign Application Priority Data

Oct. 31, 2014 (DE) ..... 20 2014 008 661 U

(51) Int. Cl.
*B66C 23/76* (2006.01)

(52) U.S. Cl.
CPC ..... *B66C 23/76* (2013.01)

(58) Field of Classification Search
CPC ..... B66C 23/62; B66C 23/72; B66C 23/74; B66C 23/76; E02F 9/18; B62D 49/085
See application file for complete search history.

(56) References Cited

U.S. PATENT DOCUMENTS

| | | | | |
|---|---|---|---|---|
| 3,684,324 | A | 8/1972 | Sterner | |
| 5,199,583 | A | 4/1993 | Weider et al. | |
| 5,518,128 | A | 5/1996 | Kröll et al. | |
| 10,189,683 | B2 * | 1/2019 | Bitz | B66C 23/76 |
| 2008/0099421 | A1 | 5/2008 | Pech et al. | |
| 2010/0224583 | A1 * | 9/2010 | Mentink | B66C 23/74 212/175 |
| 2011/0192815 | A1 | 8/2011 | Kurotsu | |
| 2015/0246795 | A1 * | 9/2015 | Copeland | B66C 23/74 414/719 |
| 2016/0280517 | A1 | 9/2016 | Oelberger et al. | |

FOREIGN PATENT DOCUMENTS

SU 749792 A1 * 7/1980

* cited by examiner

*Primary Examiner* — Michael R Mansen
*Assistant Examiner* — Juan J Campos, Jr.
(74) *Attorney, Agent, or Firm* — Dilworth & Barrese, LLP

(57) ABSTRACT

The invention relates to a mobile crane having an undercarriage and a superstructure rotatable with respect to the undercarriage about an axis of rotation and having a ballast receiving apparatus arranged at the superstructure and having at least one ballasting cylinder for receiving ballast. In accordance with the invention, the position of the ballasting cylinders receiving the ballast is varied in the ballast receiving apparatus such that the ballast can be received in positions of different distances from the axis of rotation of the superstructure.

7 Claims, 7 Drawing Sheets

MOBILE CRANE WITH BALLAST RECEIVING APPARATUS

BACKGROUND OF THE INVENTION

The invention relates to a mobile crane having an undercarriage and a superstructure rotatable with respect to the undercarriage about an axis of rotation and to a ballast receiving apparatus arranged at the superstructure and having at least one ballasting cylinder for receiving ballast.

Mobile cranes require a working space determined by the type of construction at a construction site to ensure a full and safety-compliant mode of operation. There is often only limited space available due to projecting edges at the construction site which can be produced by walls, planting or further work equipment.

In this respect, the required working space is substantially determined by two factors. Whereas the first factor is represented by the support base which is defined by the respective support apparatus depending on the equipping state, the superstructure radius of rotation as the second major factor, that is the outermost edge of the superstructure on the rotation of the superstructure about the undercarriage, determines the working space of the mobile crane. As a rule this superstructure radius of rotation is influenced by the mounted ballast plates or by the apparatus for receiving the ballast plates since an installed ballast receiving apparatus, including the ballast plates, frequently projects the furthest out of the superstructure.

If the superstructure radius of rotation is reduced, the required working space for the mobile crane admittedly reduces on the one side. However, on the other side, the distance from the center of gravity of the ballast to the axis of rotation of the superstructure about the undercarriage is reduced. This in turn, however, reduces the torque which acts against the load torque caused by the load.

DE 20 2010 002 364 U1 already looks into this problem and provides a mobile crane which has a first and a second ballast receiving apparatus which differ from one another with respect to their physical dimensions and which are selectively releasably connected or connectable to the superstructure of the mobile crane. The ballast receiving apparatus used defines the superstructure radius of rotation which is described by the outermost component or the outermost edge of the ballast receiving apparatus in the radial direction on a rotary movement of the superstructure. The support base and the superstructure radius of rotation can be matched to one another by the selective installation of the first or second ballast receiving apparatus on the mobile crane. This solution admittedly optimizes the superstructure radius of rotation, but has the result that two separate ballast receiving apparatus have to be provided and have to be kept available by the operator of the mobile crane.

SUMMARY OF THE INVENTION

It is therefore the object of the invention to further develop a mobile crane of the category whose construction space minimizes the required working space at the construction site with as few additional components as possible.

The object is solved in accordance with the invention by the combination of the features herein. A mobile crane is accordingly provided having an undercarriage and a superstructure rotatable with respect to the undercarriage about an axis of rotation and a ballast receiving apparatus arranged at the superstructure and having at least one ballasting cylinder for receiving ballast, wherein the position of the ballasting cylinders receiving the ballast in the ballast receiving apparatus is variable such that the ballast can be received in positions of different distance from the axis of rotation of the superstructure.

It is therefore particularly advantageously no longer necessary with the mobile crane in accordance with the invention to keep differently dimensioned ballast receiving apparatus available. A different superstructure radius of rotation can rather be provided with a variably arranged ballast receiving apparatus. In this respect, the ballast receiving apparatus can receive the ballast in at least two different positions. Each position has its own distance from the axis of rotation of the superstructure about the undercarriage. The same counterweight can thus exert a different counterweight torque and can act against the respective load torque to be taken up.

It is generally more sensible not to generate the static torque by the increase of the counterweight, but rather by the enlarging of the radius of the ballast since the counterweight itself also acts as a normal force on the undercarriage. The undercarriage can therefore be relieved by reducing the taken along counterweight due to the possibility of increasing the superstructure radius of rotation.

Preferred embodiments of the invention also result from the description herein.

In accordance with a first specific solution for the positional variation of the ballasting cylinders, provision can be made in accordance with the invention to support the ballasting cylinders on rails and to displace the them in accordance with the longitudinal axis of the superstructure in order thus respectively to increase or decrease the distance from the axis of rotation. On a displaceability of the ballasting cylinders along corresponding rails, a drive, for example a hydraulic piston-in-cylinder arrangement, is preferably provided for displacing the hydraulic cylinders along the rails. On provision of a corresponding drive, the ballasting cylinders can be positioned at any desired distance from the axis of rotation within the displacement range and can be fixed in position by fixing the drive.

In accordance with an alternative solution within the framework of the invention, ballasting cylinders fixed in position can also be used instead of the movable ballasting cylinders. In this case, four ballasting cylinders are preferably arranged fixed in position at the superstructure, with them each being arranged in pairs behind one another with respect to the axis of rotation of the superstructure. In this respect, the respective pair of ballast cylinders disposed closer to the axis of rotation or the pair of ballasting cylinders disposed further away from the axis of rotation can be activated for receiving the ballast. In this preferred embodiment, the counterweight radius is therefore fixed by the selection of the ballasting cylinders used.

Finally, in accordance with a further preferred aspect of the invention, the at least one ballasting cylinder is pivotable about a pivot axis vertical with respect to the superstructure. In this respect, the ballasting cylinder is advantageously fixable in its position via a locking mechanism. In this solution, two lockable positions are advantageously provided. More lockable positions for fixing the respective pivot angle of the at least one pivotable ballasting cylinder can, however, also be provided in a step-wise manner.

Two pivotable ballasting cylinders are preferably provided which are received in pivot consoles which are in turn pivotable about the vertical pivot axes.

In a particularly favorable embodiment variant, a manual operation, that is muscular strength, is provided for pivoting the ballasting cylinders. To keep the required forces in a reasonable framework, a smooth-motion support, for example from bronze or polyamide, is preferably provided. In a somewhat more complex embodiment, a drive can alternatively naturally also be provided, for example, via a pneumatic piston-in-cylinder arrangement, a hydraulic piston-in-cylinder arrangement or also a hydraulically driven spindle unit.

The locking mechanism for fixing the ballasting cylinder in a specific pivot position advantageously comprises a spring-loaded pin which can be drawn against the spring force. The pivoting of the respective ballasting cylinders arranged at a pivot console can thereby be carried out from the ground. A spring-loaded pint can her be drawn by the operator via a rod here and the pivot console can subsequently be rotated. The pin itself then automatically locks in one of the correspondingly provided end positions due to the spring load.

Finally, a location monitoring of the position of the respective ballasting cylinder is advantageously integrated which is able to forward the respective position of the monitored ballasting cylinder to the crane control. The position of the counterweight, which can be determined by the respective position of the ballasting cylinder, is a criterion for the payload table of the crane to be used. Human error on the inputting of the data underlying the payload table can be precluded by the monitoring of the position of the pivot consoles since the input is automated.

BRIEF DESCRIPTION OF THE DRAWINGS

Further features, details and advantages of the invention will be explained in more detail with reference to an embodiment shown in the drawing. There are shown:

FIGS. 1A', 1B': enlarged views of the respectively-denoted areas in FIGS. 1A and 1B;

FIGS. 2A', 2B': enlarged views of the respectively-denoted areas in FIGS. 2A and 2B;

DESCRIPTION OF THE PREFERRED EMBODIMENTS

Figure 1A:
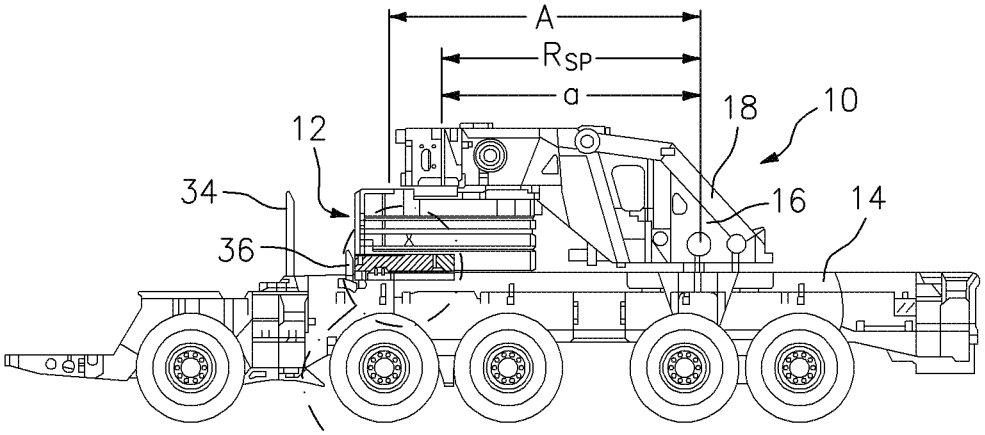
FIGS. 1A, 1B: in each case, a side view and a plan view of a part of a mobile crane in accordance with an embodiment of the present invention in which the ballast for a small superstructure radius has been received.
Figure 1A:
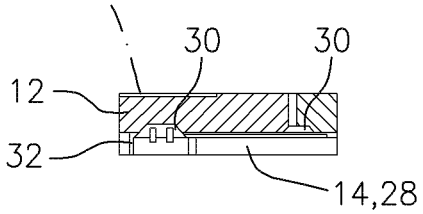
Figure 1B:
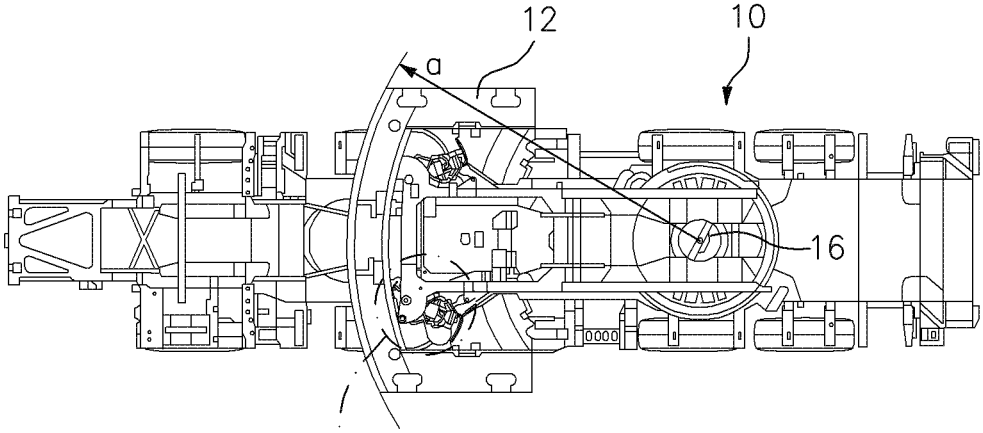
Figure 1B:
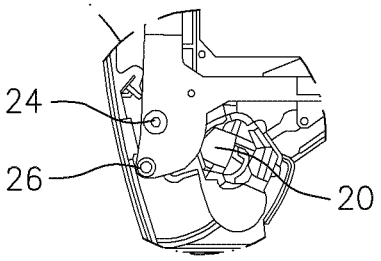

FIGS. 1*a* and 1*b* each show a mobile crane 10 which is only shown in parts and which has a ballast receiving apparatus for receiving a ballast 12. The mobile crane has an undercarriage 14 and a superstructure 18 arranged rotatable about an axis of rotation 16 on the undercarriage 14.

Figure 2A:
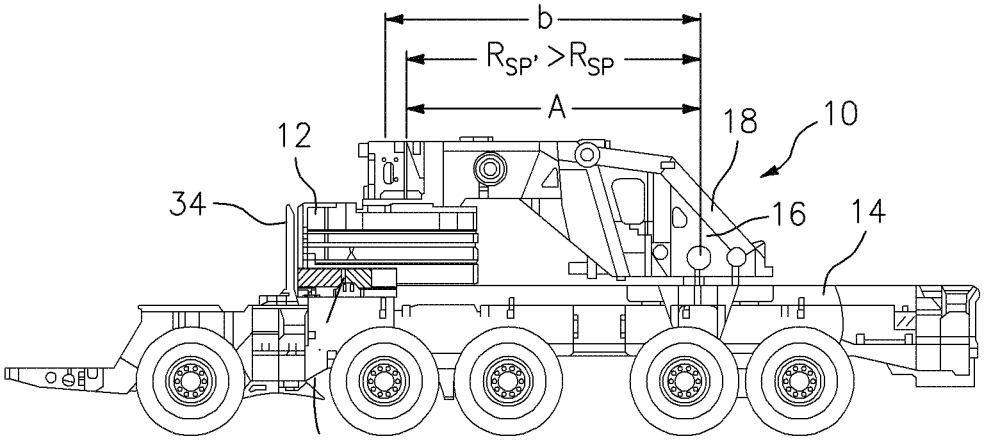
FIGS. 2A, 2B: a representation of the mobile crane corresponding to FIG. 1 in which, however, the ballast is received in a position in which a large superstructure radius has been implemented.
Figure 2A:
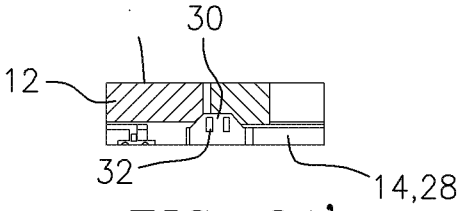

In accordance with the invention, the ballast receiving apparatus is arranged at the superstructure 18 such that it is positionally variable. The superstructure radius of rotation can hereby be converted from a small radius (FIGS. 1*a*, 1*b*) to a large radius (FIGS. 2*a*, 2*b*).

Figure 2B:
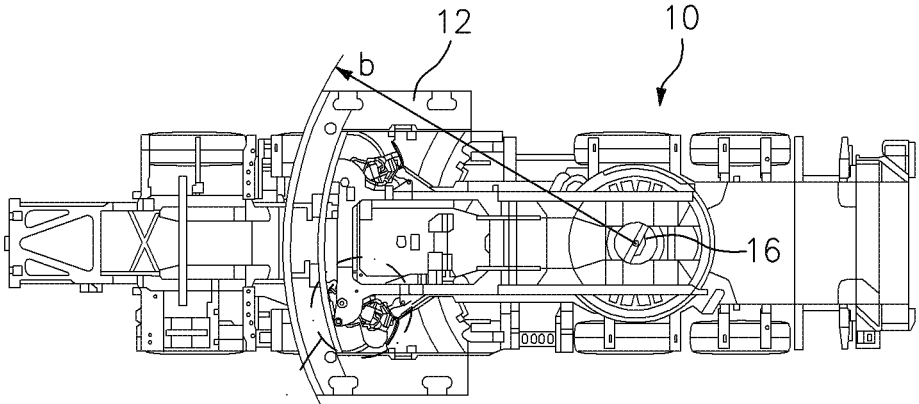
Figure 2B:
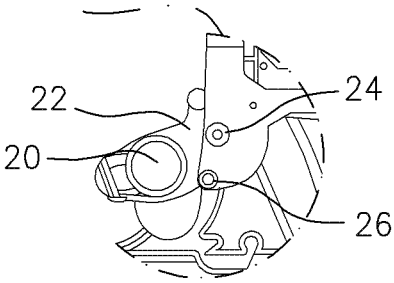

The positional variation of the ballast receiving apparatus is implemented in the embodiment described here by pivotable ballasting cylinders 20 (cf. enlarged detailed representation of FIG. 1*b* or of FIG. 2*b*). As can be seen the clearest from the enlarged detail of FIG. 2*b*, the ballasting cylinders 20 are received in a pivot console 22. The pivot console 22 is in this respect respectively pivotable about a vertical pivot axis 24. The different counterweight radius (as is shown in FIGS. 1*a* and 1*b* in comparison with FIGS. 2*a* and 2*b*) is therefore determined by the pivot angle and the dimension, that is the length, of the pivot console 22. A locking mechanism 26 which comprises a pluggable pin in a simple embodiment is provided to be able to hold the ballasting cylinder 20 and the associated pivot console 22 in a specific position.

A manual operation, that is muscular strength, is preferably provided as the drive for the pivot movement. The design of the ballast receiving apparatus can hereby be substantially simplified. To keep the required forces in a reasonable framework a smooth-motion support can be used, for example of bronze sleeves or polyamide sleeves. Alternatively, a drive can naturally also be provided here via a pneumatic piston-in-cylinder arrangement, a hydraulic piston-in-cylinder arrangement or a spindle unit (not each shown here).

The ballasting cylinders 20 which can be used here can be of the same construction or almost of the same construction as the ballasting cylinders of the prior art. The basic mode of operation of the ballasting cylinders is also exactly the same as in the prior art in accordance with the present invention, apart from their positional variation by the pivoting. Reference can be made here to the mode of operation such as is described, for example, in DE 20 2010 002 364 U1.

The supply of the energy and signals for the ballasting cylinders 20 takes place via a hose/cable winding or an energy supply chain in a manner not show in any more detail in the Figure. Electrical, hydraulic and, optionally, pneumatic lines are to be provided correspondingly in the energy supply chain.

The ballasting cylinders 20 can therefore be brought into two positions and respectively locked by a corresponding pivoting. In the position in accordance with FIGS. 1*a* and 1*b*, the ballasting cylinders 20 have a smaller distance a from the axis of rotation 16 than in the outwardly pivoted position in accordance with FIGS. 2*a* and 2*b* in which the corresponding distance is marked by b.

As is known from the prior art, an apparatus 28 can be provided at the undercarriage 14 to receive the ballast 12. Once the ballast 12 has been placed on in this manner, it is ready for ballasting by the ballasting cylinders 20. Since the ballast 12 can, however, be received with two different radii of rotation, associated cut-outs 30 for each provided radius of rotation are applied in the receiver of the ballast. These cut-outs correspond to corresponding projections 32 on the apparatus 28 so that the ballast 12 can be received in both positions, that is both in the position of the large counterweight radius and in the position of the small counterweight radius.

Alternatively, however, separate apparatus having corresponding cut-outs can also be provided for every ballast radius. To design the receiving of the ballast 12 on the apparatus 28 in a simple manner, ballast stops 34 and 36 respectively, such as likewise known from the prior art, are installed. The ballast stops 36 for the smaller radius (cf. FIG. 1*a*) can be foldable.

Due to the construction, the center of gravity of the ballast 12 projects far beyond the rear of the revolving deck with a large pivot radius b. In order nevertheless to be able to clamp the ballast horizontally to the revolving deck when pulling up, corresponding stops 34 are provided at the pivot consoles 22 or at the ballasting cylinders 20 themselves.

Figures 3A, 3B:
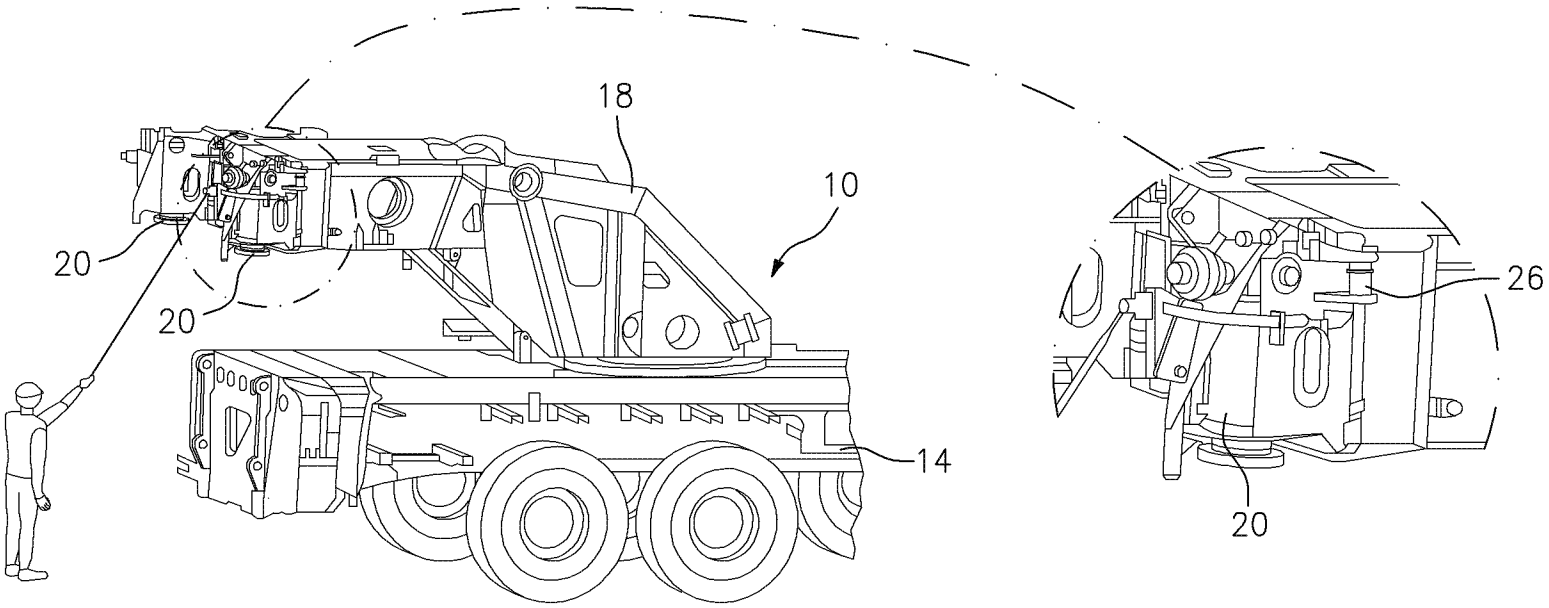
FIG. 3A: a partially sectioned perspective representation of the mobile crane in accordance with FIGS. 1 and 2 for illustrating the operation of the pivot mechanism.
FIG. 3B: an enlarged view of the encircled area in FIG. 3A.
Figure 4A:
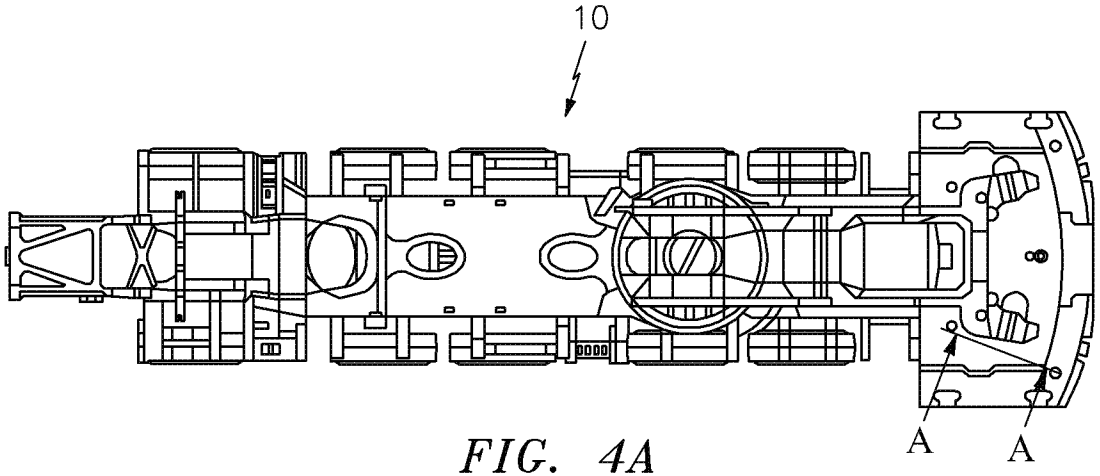
FIGS. 4A, 4B: a plan view and an enlarged side view in the direction of gaze A-A corresponding to the plan view for illustrating the locking mechanism in accordance with the invention.
Figure 4B:
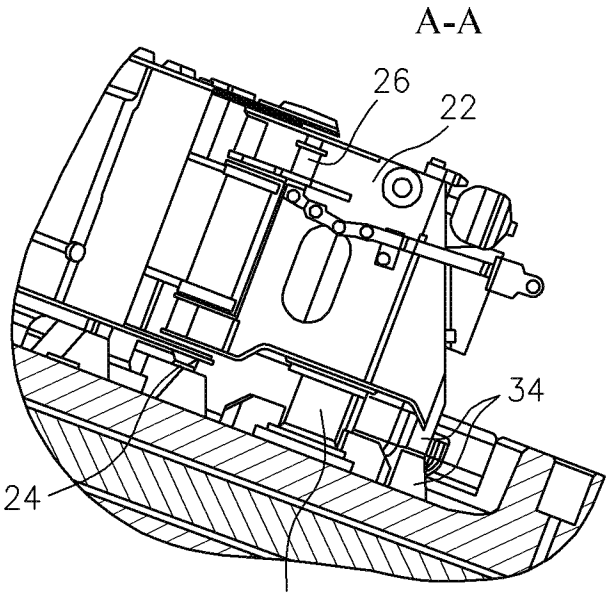

The enlarged representation in accordance with FIG. 4 also shows the embodiment of the locking mechanism 26. It can, as FIG. 3 also shows, take place from the ground by the operator. The spring-loaded pin 26 is here drawn via a rod and the pivot console is subsequently rotated. The pin 26 is automatically locked in a respective one of the two provided end positions due to the spring loading.

Alternatively, the pivot console 22 can also be rotated and locked from a platform of the revolving deck, for example by means of a fixed or pluggable lever (not shown in any more detail here).

The position of the ballast is a criterion for the payload table of the mobile crane 10 to be used. To be able to reliably preclude human error here, the position of the ballasting cylinder pivot consoles 22 is monitored by the crane control.

In general, a switch at a pivot console 22 can be sufficient to be able to determine the position of the two pivot consoles 22 and thus of the ballast 12. Since for geometrical reasons no ballast can be received as long as the ballast cylinder pivot consoles 22 have not been located at the same position.

In this solution, a switch having two transponders per pivot console is selected to be able to detect each position. Alternatively, however, it is naturally also possible to provide as a minimum a mechanical switch, for example a roller limit switch, or as a minimum an inductive switch or as a minimum a switch plus as a minimum a transponder.

FIG. 5 illustrates the positioning of the ballast on the apparatus 28 of the undercarriage 14 in a schematic manner. The fully shaded circles represent the projections 32 on the apparatus 28. In accordance with the upper representation in FIG. 5, that is in the implementation of the small superstructure radius of rotation, the protrusions engage into the outer two cut-outs 30 in the receiving plate of the ballast 12. This upper representation corresponds to the representation in accordance with FIG. 1*a*. The lower representation in contrast corresponds to the arrangement of the ballast 12 in accordance with FIG. 2*a*, that is to the comparatively larger superstructure radius of rotation. The respective other two cut-outs 30 in the reception plate 12 of the ballast are here inserted into the projections 32 of the apparatus 28.

The ballast 12 is positioned in mounting position for the movement to the upper carriage 18, by the device 28 on the lower carriage 14. For this purpose, ballasting cylinders 20 are provided. For example, FIGS. 7A-D schematically illustrate movement of a ballasting cylinder 20 together with ballast 12 carried thereon. In other words, the ballast 12, i.e., the ballast base plate 12 (on which ballast is appropriately stacked), is vertically lifted by the cylinder 20 off the undercarriage 14. In FIGS. 7A-D, ballast base plate 12 is shown as the lower plate, with another ballast plate stacked thereon. However, more than one additional ballast plate can be stacked on the ballast base plate.

Figure 5A:
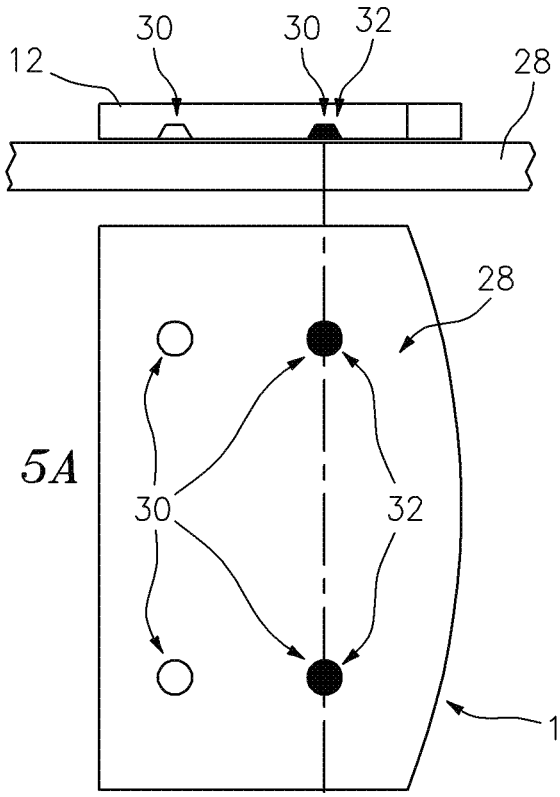
FIGS. 5A, 5B: sketched representations for illustrating the position of the ballast after being placed on the undercarriage.
Figure 5B:
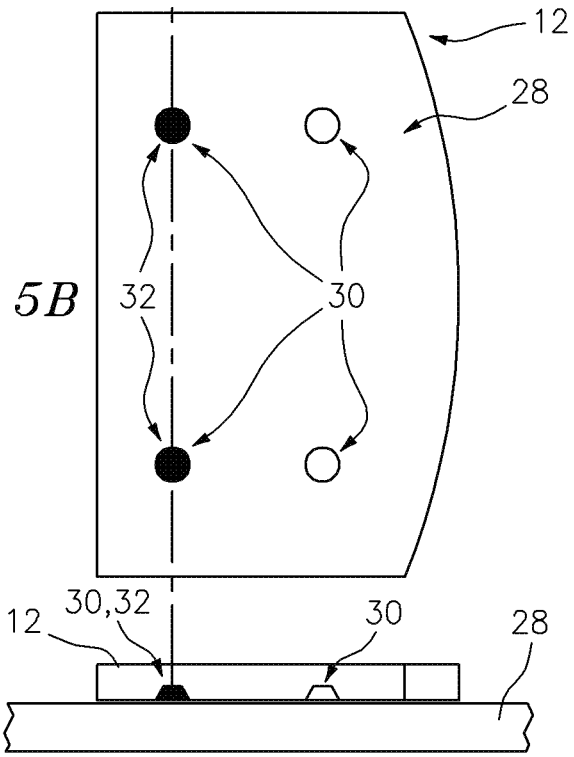
Figure 6:
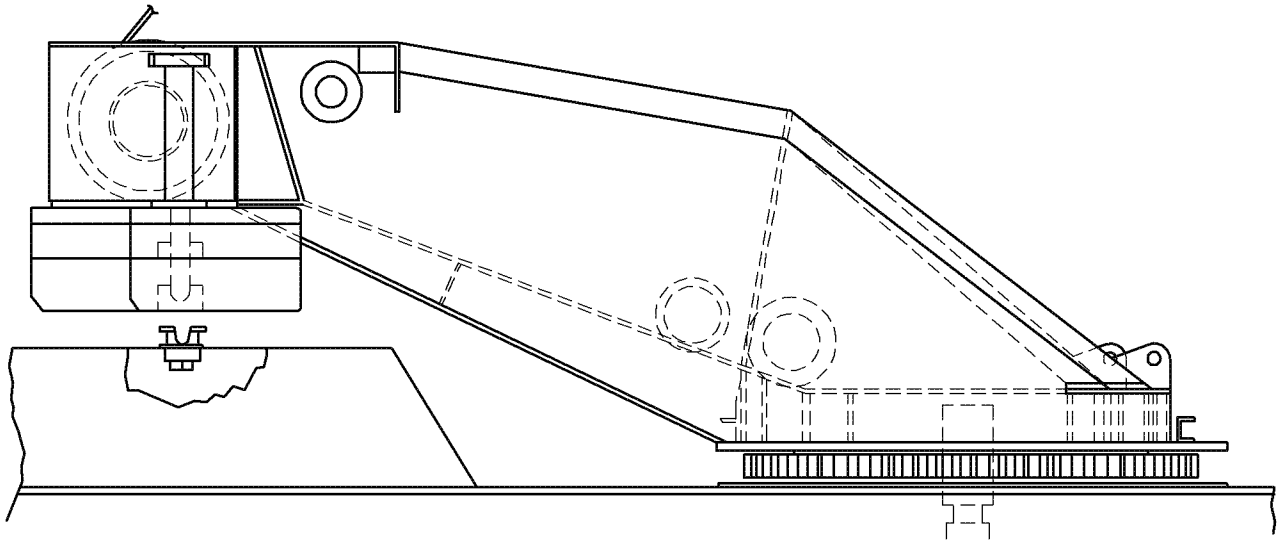
FIG. 6: an enlarged side view similar to FIGS. 1A and 2A and illustrating receiving ballast from the undercarriage.
Figure 7D:
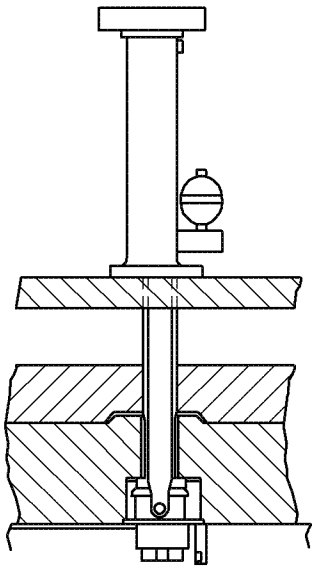
FIGS. 7A, 7B, 7C, 7D: schematic illustrations of the ballasting cylinders of the ballast receiving apparatus gradually receiving the ballast from the undercarriage.
Figure 7C:
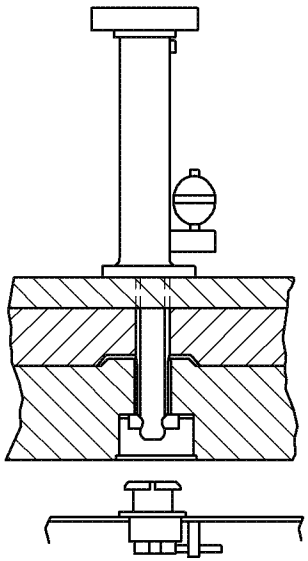
Figure 7B:
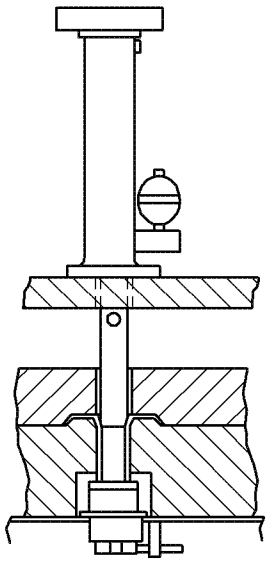
Figure 7A:
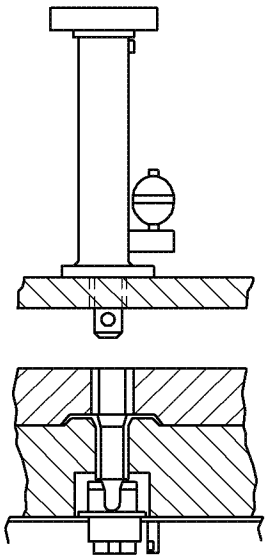

The enlarged sections shown in FIGS. 1A' and 2A' clearly show the relationship between positioning of the ballast at the locations shown in FIGS. 5A and 5B and the side views of the superstructure 18 respectively shown in FIGS. 1A and 2A. In this regard, the enlarged sections shown in FIGS. 1A' and 2A' have been re-produced at the top and bottom of FIGS. 5A and 5B respectively (FIGS. 1A and 5A are positioned in opposite directions from one another, as are FIGS. 2A and 5B).

As illustrated in the present application, the ballasting cylinders 20 move the ballast, i.e., the ballast base plate 12 and the ballast stacked thereon, up and down in only the vertical direction. The ballasting cylinders 20 themselves do not perform a horizontal movement. Prior to crane operation, the ballast base plate 12 is placed on the apparatus 28 situated on the undercarriage 14 and positioned over projections 32. As shown in FIGS. 5A and 5B, the ballast base plate 12 can be positioned for either a large ballast radius $R_{sp'}$ or a small ballast radius $R_{sp}$. Since the apparatus 28 with the protrusions 32 is a fixed component of the undercarriage 14, the distance A denoted in FIGS. 1A and 2A is always constant. However, the ballast radius can be changed by inserting the protrusions 32 in the different cutouts 30 as shown in FIGS. 5A and 5B.

In other words, moving the protusions 32 to seat in the different cutouts 30 as shown in FIGS. 5A and 5B, will allow ballast to be stably stacked on the protrusions and then appropriately retrieved and lifted by the ballasting cylinders 20 and ballasting base plate 12, and onto the superstructure 18.

The invention claimed is:

1. A mobile crane having an undercarriage and a superstructure rotatably mounted upon the undercarriage about an axis of rotation and having a ballast receiving apparatus arranged at the superstructure and having at least one ballasting cylinder arranged for receiving ballast from the undercarriage and moving the ballast onto the superstructure, wherein position of the at least one ballasting cylinder arranged for receiving the ballast from the undercarriage is variable in the ballast receiving apparatus such that the ballast is receivable from the undercarriage in positions of different distances from the axis of rotation of the superstructure, and the at least one ballasting cylinder is pivotable about a pivot axis vertical with respect to the superstructure.

2. A mobile crane in accordance with claim 1, wherein the at least one ballasting cylinder can be fixed in positions via a locking mechanism.

3. A mobile crane in accordance with claim 1, wherein the ballast is receivable in two different distances from the axis of rotation of the superstructure.

4. A mobile crane having an undercarriage and a superstructure rotatably mounted upon the undercarriage about an axis of rotation and having a ballast receiving apparatus arranged at the superstructure and having at least one ballasting cylinder arranged for receiving ballast from the undercarriage and moving the ballast onto the superstructure, wherein position of the at least one ballasting cylinder arranged for receiving the ballast from the undercarriage is variable in the ballast receiving apparatus such that the ballast is receivable from the undercarriage in positions of different distances from the axis of rotation of the superstructure, the at least one ballasting cylinder can be fixed in positions via a locking mechanism, and the at least one ballasting cylinder is received in pivot consoles which are pivotable about vertical pivot axes.

5. A mobile crane having an undercarriage and a superstructure rotatable with respect to the undercarriage about an axis of rotation and having a ballast receiving apparatus arranged at the superstructure and having at least one ballasting cylinder for receiving ballast, wherein position of the at least one ballasting cylinder receiving the ballast is variable in the ballast receiving apparatus such that the ballast can be received in positions of different distances from the axis of rotation of the superstructure, the at least one ballasting cylinder can be fixed in position via a locking mechanism, and the locking mechanism comprises a spring-loaded pin which can be drawn against a spring force, with the pivoting of the respective ballasting cylinder arranged at a pivot console being able to be carried out from the ground.

6. A mobile crane having an undercarriage and a superstructure rotatably mounted upon the undercarriage about an axis of rotation and having a ballast receiving apparatus arranged at the superstructure and having at least one ballasting cylinder arranged for receiving ballast from the undercarriage and moving the ballast onto the superstructure, wherein position of the at least one ballasting cylinder arranged for receiving the ballast from the undercarriage is variable in the ballast receiving apparatus such that the ballast is receivable from the undercarriage in positions of different distances from the axis of rotation of the superstructure, and receiving means are arranged at the receiving apparatus such that the ballast can be placed down in the different positions on the receiving apparatus.

7. A mobile crane having an undercarriage and a superstructure rotatably mounted upon the undercarriage about an axis of rotation and having a ballast receiving apparatus arranged at the undercarriage and having at least one ballasting cylinder arranged for receiving ballast from the undercarriage and moving the ballast onto the superstructure, wherein position of the at least one ballasting cylinder arranged for receiving the ballast from the undercarriage is variable such that the ballast is receivable from the undercarriage in positions of different distances from the axis of rotation of the superstructure, and said ballast receiving apparatus arranged at the undercarriage comprises projections arranged to receive complementary cutouts on plates of the ballast at different positions on the undercarriage.

* * * * *